US005671685A

United States Patent [19]

Ughi

[11] Patent Number: 5,671,685

[45] Date of Patent: Sep. 30, 1997

[54] ACOUSTIC BARRIER, PARTICULARLY FOR RAILWAY SUPERSTRUCTURES

[76] Inventor: Stefano Ughi, Via Cosimo del Fante 8, 20122 Milano, Italy

[21] Appl. No.: 607,084

[22] Filed: Feb. 26, 1996

[30] Foreign Application Priority Data

Feb. 28, 1995 [IT] Italy ..... MI95A0374

[51] Int. Cl.[6] ..... B61D 17/00

[52] U.S. Cl. ..... 105/452; 105/1.1; 238/382; 181/210

[58] Field of Search ..... 105/1.1, 1.3, 452; 238/382; 181/210

[56] References Cited

U.S. PATENT DOCUMENTS

| | | | |
|---|---|---|---|
| 2,925,051 | 2/1960 | Van Der Sluys | 105/452 |
| 3,212,453 | 10/1965 | Lich | 105/452 |
| 4,756,256 | 7/1988 | Rains et al. | 105/1.1 |
| 5,329,073 | 7/1994 | Shono et al. | 181/210 |

FOREIGN PATENT DOCUMENTS

| | | | |
|---|---|---|---|
| 57765 | 8/1982 | European Pat. Off. | 105/1.3 |
| 2558676 | 7/1977 | Germany | 105/452 |
| 3532765 | 3/1987 | Germany | 181/210 |
| 11509 | 1/1977 | Japan | 105/452 |
| 43209 | 4/1977 | Japan | 105/452 |
| 19143 | of 1915 | United Kingdom | 105/452 |

*Primary Examiner*—S. Joseph Morano
*Attorney, Agent, or Firm*—Herbert Dubno

[57] ABSTRACT

The acoustic barrier, particularly for railways, comprises at least a first sound-proofing member (2), arranged at the sides of a train (3) proximate to at least each bogie (4), and at least a second sound-proofing member (5) arranged on the supporting plane (6) of the rails (8) at the sides of said rails, the second sound-proofing member cooperates with the first sound-proofing member for abating the noise generated by the passage of the train on the rails.

11 Claims, 5 Drawing Sheets

ACOUSTIC BARRIER, PARTICULARLY FOR RAILWAY SUPERSTRUCTURES

FIELD OF THE INVENTION

The present invention relates to an acoustic barrier, particularly for railway superstructures.

BACKGROUND OF THE INVENTION

Acoustic pollution has now reached a paramount importance in designing, developing, and producing machines and apparatus in all fields, particularly in the construction and industrial fields.

There are several possibilities of eliminating noise without reducing the productivity. It is, for example, possible to intervene in the arrangement of the machines, to modify the noise-generating parts, to provide shields or active systems, to improve the sound proofing of the buildings, or to install sound-proofing or noise-reducing barriers.

In railways, for example, this problem has been particularly felt because railways passing close to or provided in cities are a great source of acoustic pollution.

So far, the problem of acoustic pollution of the railways has been partially solved by arranging sound-proofing barriers at the sides of the ballast or, in the case of rail on tie plates, at the sides of the tie plates.

Conventional acoustic barriers however limit only a fraction of the noise produced by the passage of trains.

OBJECTS OF THE INVENTION

An object of the present invention is to eliminate the above described shortcomings of conventional acoustic barriers, particularly for railways.

Another important object of the invention is to provide an acoustic barrier, particularly for railways, adapted to almost completely abate the noise produced by the passage of a train.

A further object of the invention is to provide an acoustic barrier, particularly for railways, adapted to abate the noise and to improve the aerodynamics of the train.

A further object of the invention is to provide an acoustic barrier, particularly for railways, adapted to abate the noise and to mechanically protect the moving members (the train wheels).

Still a further object of the invention is to provide an acoustic barrier which also has an intrinsic safety in that it prevents objects from being dragged under or close to the wheels of the passing train.

SUMMARY OF THE INVENTION

These objects are achieved by an acoustic barrier, particularly for railways, which comprises at least a first sound-proofing member, arranged at the sides of a train proximate to at least each bogie, and at least a second sound-proofing member arranged on the supporting plane of the rails at the sides of the rails, the second sound-proofing member cooperating with the first sound-proofing member for abating the noise generated by the passage of said train on said rails.

BRIEF DESCRIPTION OF THE DRAWING

Further characteristics and advantages of the invention will become more apparent from the following description of a preferred but not exclusive embodiment of the acoustic barrier, particularly for railways, illustrated, by way of example in the accompanying drawing in which.

SPECIFIC DESCRIPTION

Figure 1:
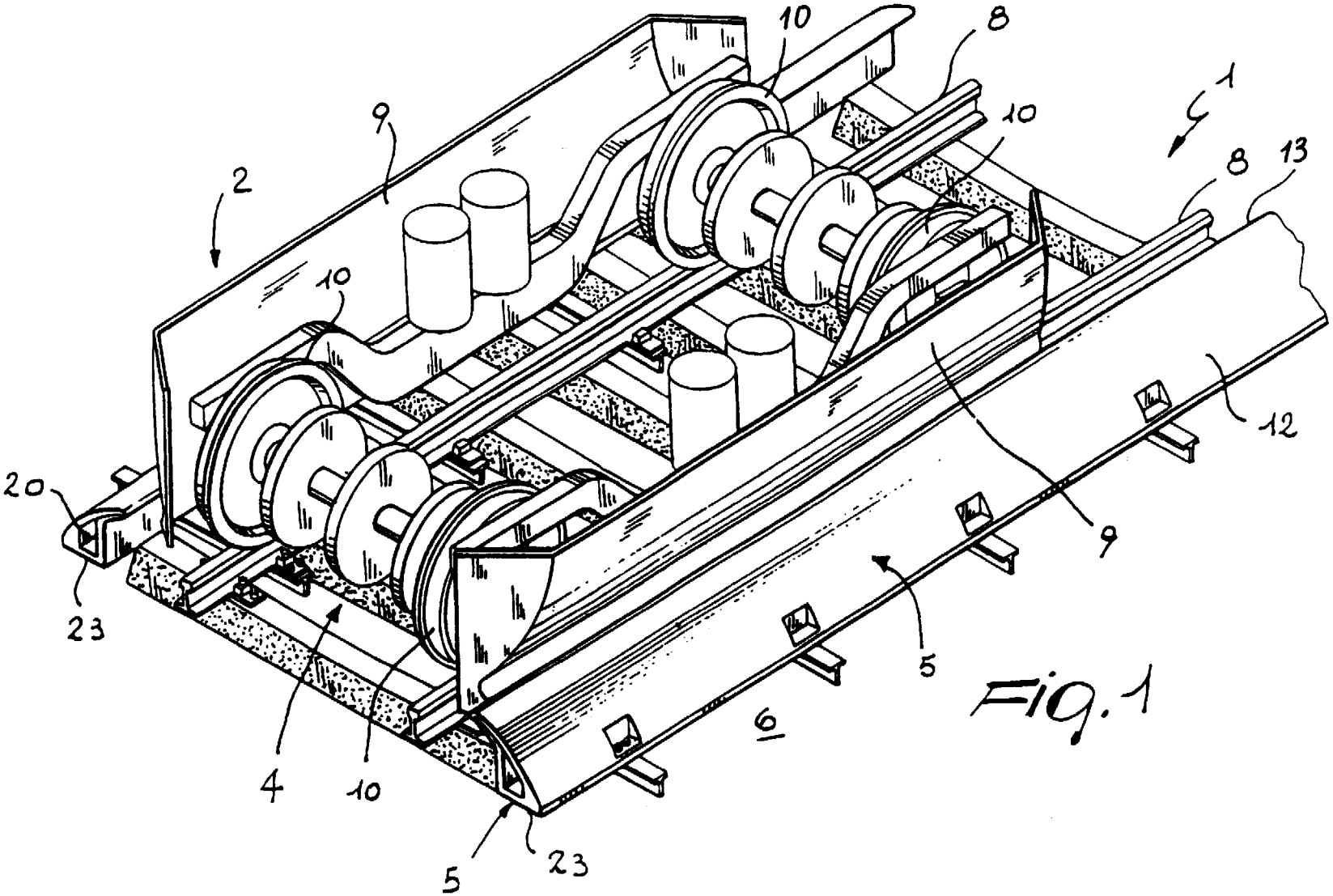
FIG. 1 is a perspective view of a train bogie showing its case and barrier according to the invention.

The accoustic barrier, particularly for railways, according to the invention, generally designated by the reference numeral 1, comprises at least a first sound-proofing member 2 arranged at the sides of a train 3, proximate to at least each bogie 4.

The barrier also comprises at least a second sound-proofing member 5 arranged on a support plane 6 of rails 8.

In particular, the second sound-proofing member 5 is arranged as close as possible to rails 8 in order to cooperate with first sound-proofing member 2 thus practically completely abating the noise generated by the passage of train 3 on rails 8.

First sound-proofing member 2 is defined by a case 9 covering the wheels 10 of the train bogie 4.

Case 9 has aprons which conveniently extend proximate to rails 8 in order to cover wheels 10 completely and to perform a first abating of the noise generated by the wheels turning or sliding on rails 8.

Advantageously, case 9 is associated with bogie 4 so that it is not influenced by the swinging and movements of the train frame due to the shock absorbers provided for the passengers comfort.

Furthermore, as is known, some fast trains lean into the curves and therefore should-the case be associated to the car frame it would hit the support plane 6 of rails 8.

In a preferred embodiment of the invention, case 9 is associated with bogie 4 with shock absorber members, such as springs or plastic cushions, and has a portion 11 between bogie 4 and the frame of train 3, adapted to improve the acoustic insulation of the passenger cabin of the train.

In other words, in this embodiment, the case is provided to completely cover bogie 4 in order to acoustically insulate it.

Second sound-proofing member 5 has a noise reducing and abating barrier 12.

Barrier 12 is arranged parallel to rails 8 and is substantially higher than the rails.

Figure 4:
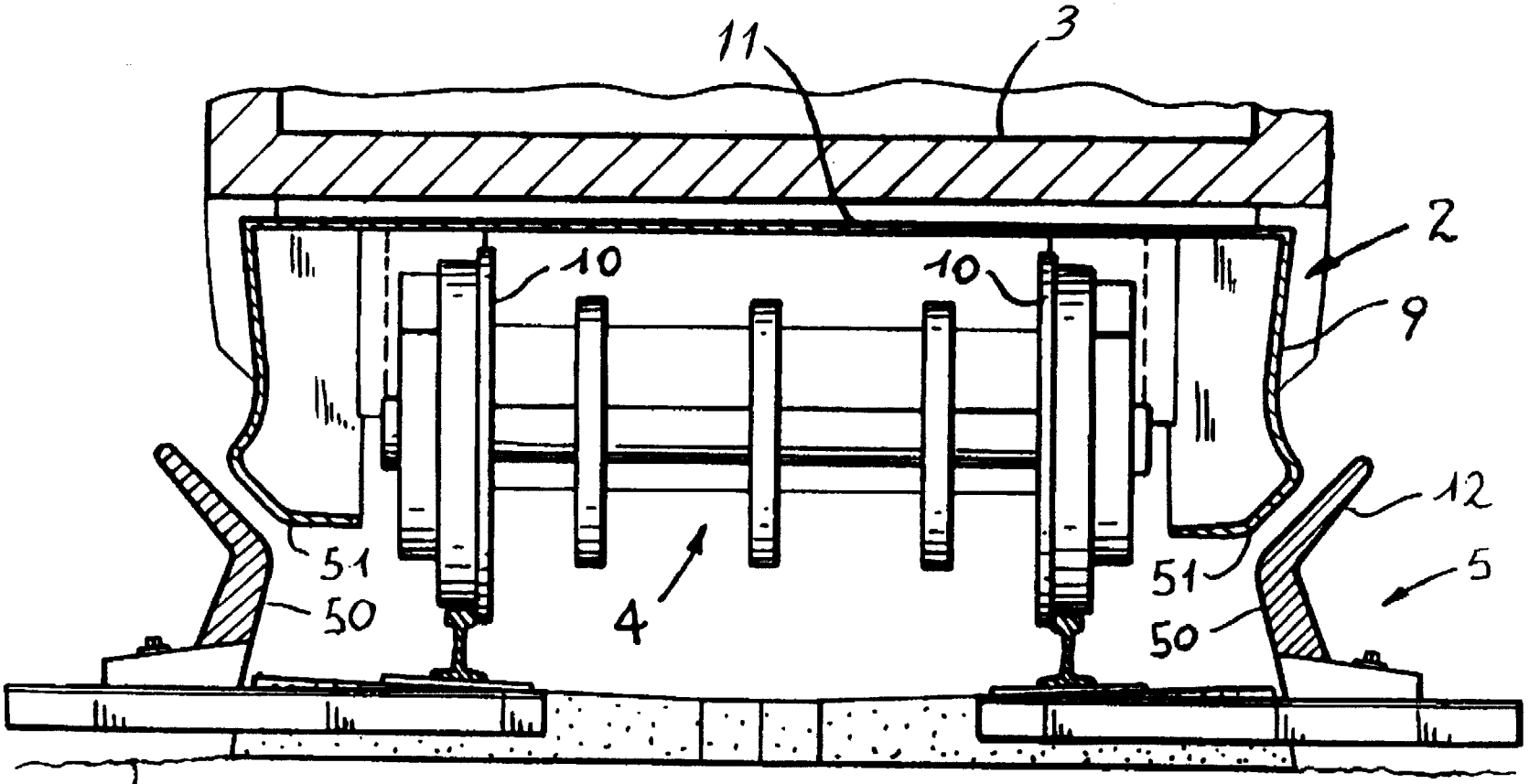
FIG. 4 shows a variated embodiment of the case and the second sound-proofing member according to the invention.
Figure 5:
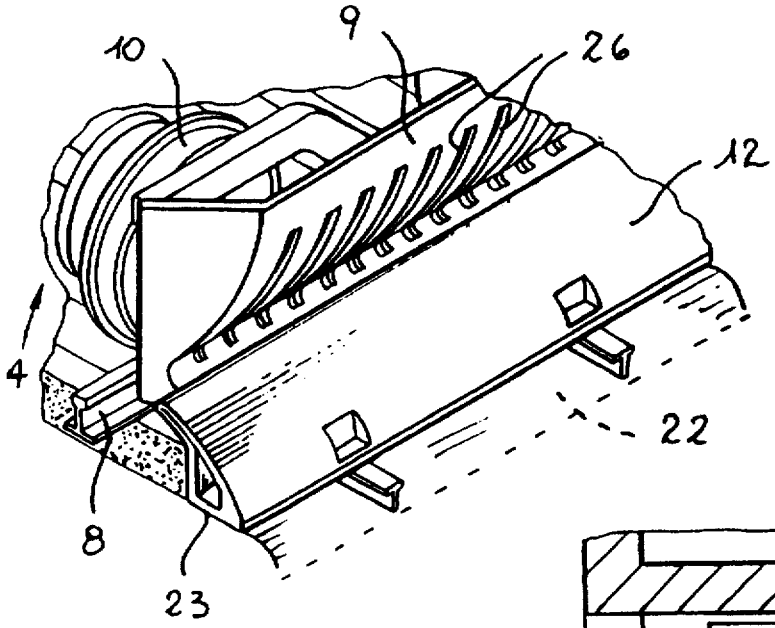
FIG. 5 is a perspective view of the fins of the case according to the invention.
Figure 6:
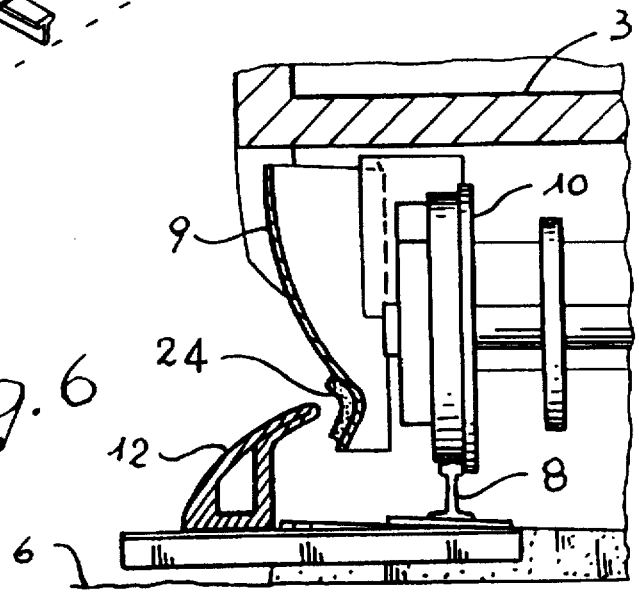
FIG. 6 is a fragmentary view otherwise similar to FIG. 1 which shows the anti-friction members on the case according to the invention.
Figure 7:
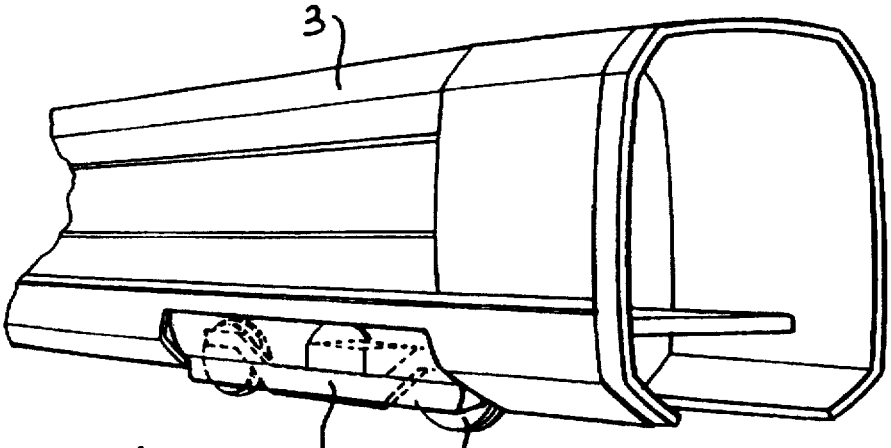
FIG. 7 is a schematic perspective view of a train having the case mounted on the bogie, according to the invention.

As shown in FIG. 4, at least barrier 12 has a portion 50 off sound-proofing material extending towards case 9, while case 9 has a portion 51 extending towards portion 50 of barrier 12.

In a particular embodiment, barrier 12 has an upper end 13 extending towards case 9 so that the lower end 14 of case 9, extending towards upper end 12, form a concave fold 15 proximate to the barrier upper end 13.

Figure 2:
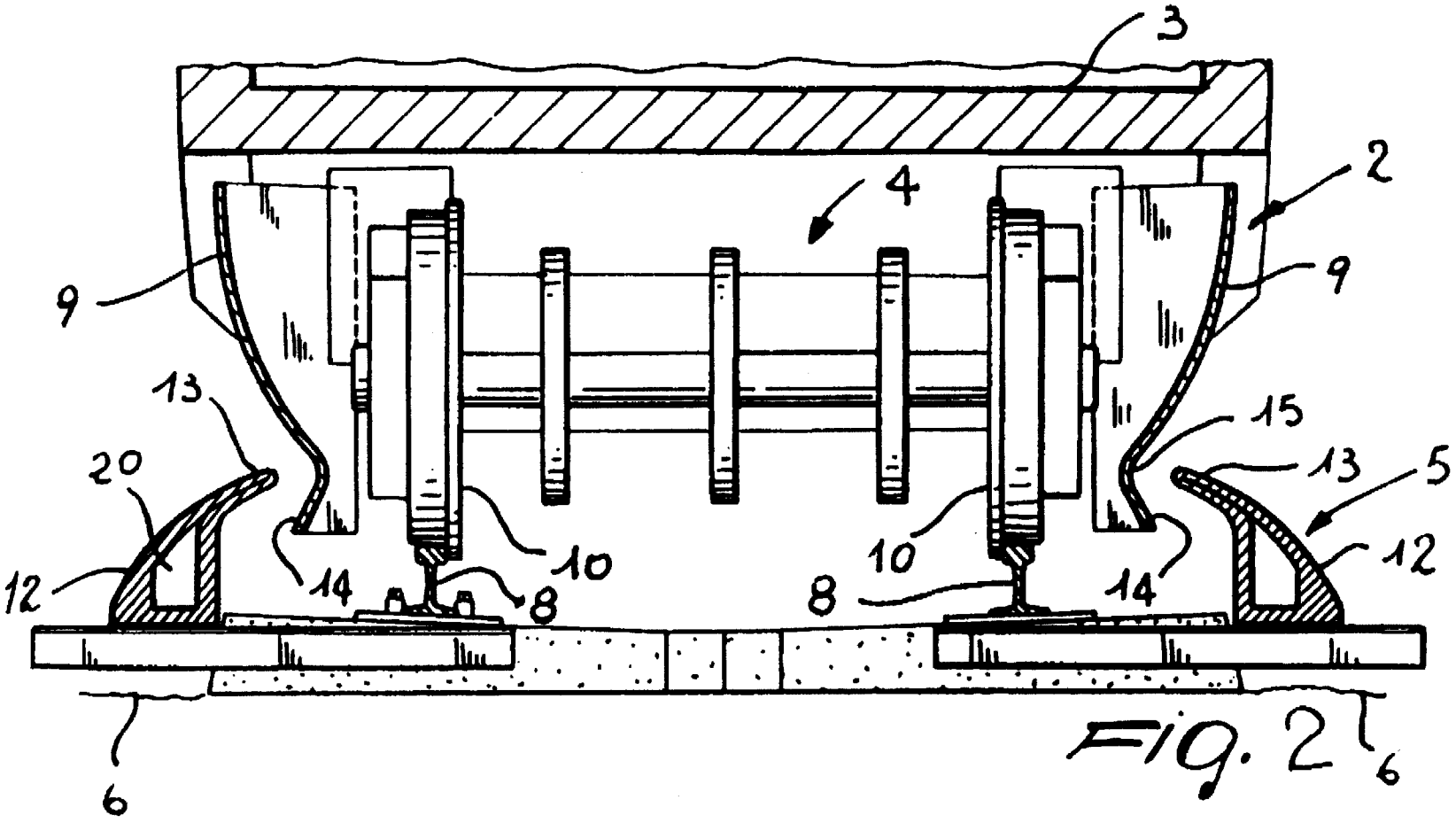
FIG. 2 is a front view, partially in section, of the acoustic barrier and the bogie of FIG. 1, according to the invention.
Figure 3:
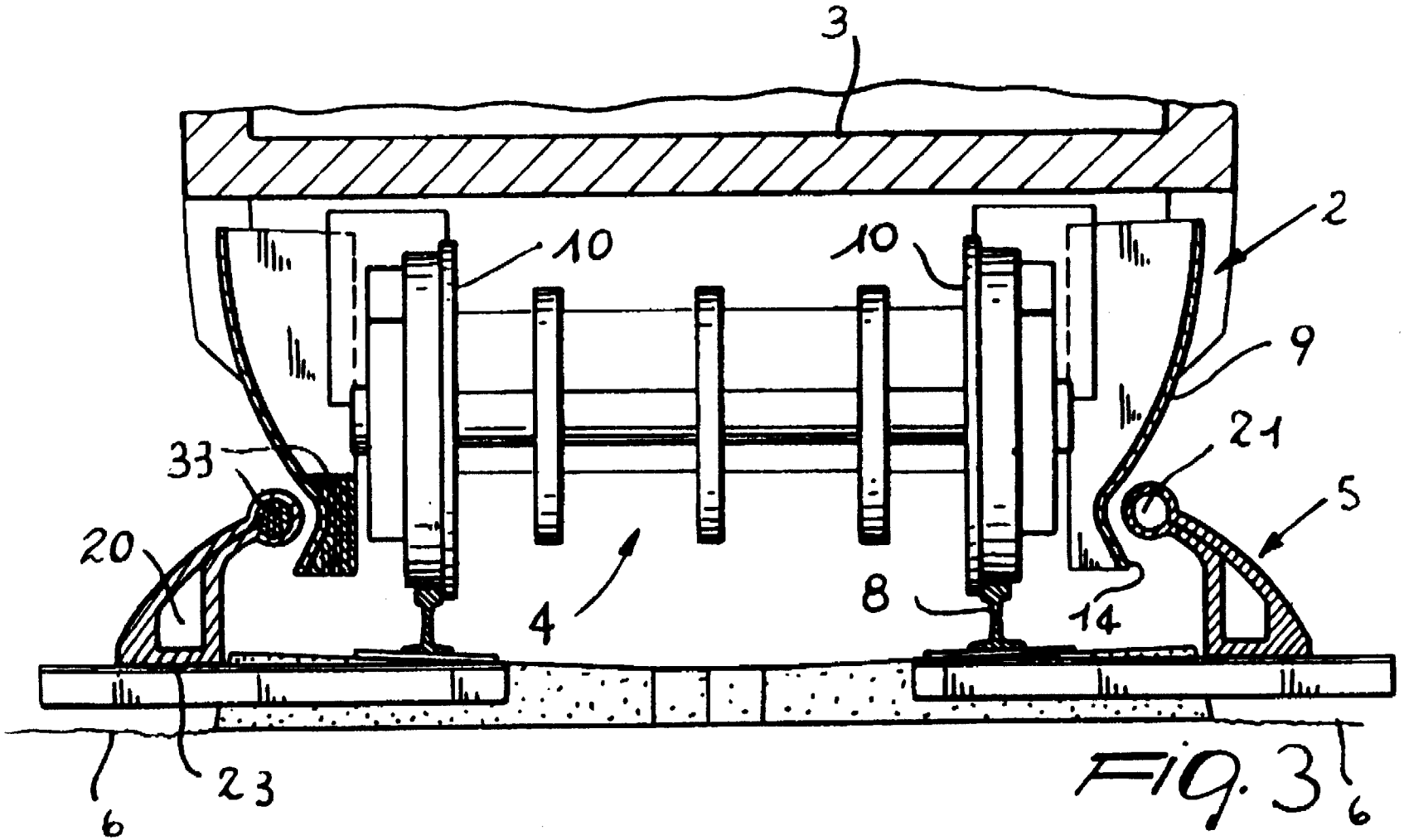
FIG. 3 is a view similar to FIG. 1 which shows another embodiment of the barrier according to the invention.

In this manner, as shown in FIGS. 2, 3, and 4, barrier 12 and case 9 have a complementary shape adapted to create a labyrinth that converges the noise produced by bogie 4, towards barrier 12 which almost completely abates the noise. The juxtaposed lower portion of the case and the upper portion or barrier 12 define a slot which is inclined to the support plane 6.

It is also noted that barrier 12 has a first channel 20 inside its body. First channel 20 is adapted to stiffen the barrier and to abate noise, and is also adapted to accommodate electric cables which are thereby protected by the environment and by tampering or damages along the line.

In a preferred embodiment of the invention, barrier 12 has a second stiffening channel 21 on its upper end 13. Electrical and telephone cables may be inserted in second channel 21 for protection against the environment and damages.

It is specified that channel 21 and the portion of case 9 facing second channel 21, are provided with layers of sound-proofing material 33.

Barrier 12 also has one or more flexible fins 22 adapted to merge its base 23 with support plane 6 of rails 8 should the support plane be inclined such as a ballast.

It is also noted that either the case or the barrier, or both, have anti-friction members 24 on their facing sides, should case 9 hit barrier 12 in case of swervings of the train or other unexpected reasons.

If necessary, case 9 may also have one or more fins 26 adapted to force an air flow towards the braking system of bogie 4 for cooling the brakes.

Furthermore, both case 9 and barrier 12 are provided with stiffening ridges, not shown in the drawings, and may be provided with electronic systems for example for detecting the exact position of the train on the railway, for measuring the exact speed of the train, or for activating one or more safety systems or level crossings or signals at the stations.

Advantageously, case 9 may be made of alveolar fiberglass having a high mechanical and chemical resistance, because of the considerable stress to which the case is subjected and because of the chemical attacks of several materials such as oils, salt, etc., normally present in a railway bogie.

The use of the acoustic barrier according to the invention is apparent from what has been described and illustrated.

In particular, the combination of barrier 12 and case 9, together with their particular shape, provide a unique protective barrier against the noise generated by the train passage, which is adapted to abate the noise almost completely since the sound waves have no possibility of propagation.

It has been seen in practice that the acoustic barrier according to the invention is particularly advantageous because it almost completely abate the noise generated by the passage of the train and, at the same time, improves the train aerodynamics. The acoustic barrier also effectively mechanically protects the bogie members also preventing objects from being dragged under or close to the wheels, as frequently happens in conventional trains, also preventing people or animals from being drawn under the wheels.

The acoustic barrier according to the invention may have numerous modifications and variations, all within the inventive concept. Furthermore, all the details may be substituted with technically equivalent elements.

The materials employed, as well as the dimensions, may be any according to the specific needs and the state of the art.

I claim:

1. A noise-abating railway assembly, comprising:

a railway track comprising means for forming a support plane, and a pair of railway rails mounted on said means and said support plane;

a railway car traveling along said track and comprising at least one bogie having wheels riding respectively on said rails and a car body resiliently supported on said bogie; and noise-abatement means for abating noise produced by said wheels riding on said rails, said noise-abatement means including:

a pair of downwardly extending aprons secured to said bogie on opposite sides of said bogie and having lower ends below axes of said wheels, and respective sound-proofing members mounted on said plane, extending along said track, flanking said track, and juxtaposed with a respective one of said aprons, said sound-proofing members extending upwardly above said lower ends to overlap said aprons, said lower ends of said aprons and upper ends of said sound-proofing members being inclined to said support plane to define between each lower end of an apron and a respective upper end of a sound-proofing member juxtaposed therewith a respective slot inclined to said support plane.

2. The noise-abating railway assembly defined in claim 1 wherein said aprons form part of a case extending over said bogie and independent from said body.

3. The noise-abating railway assembly defined in claim 2 wherein said case is connected shock-absorbingly with said bogie and has a portion between said body and said bogie for acoustically insulating a passenger cabin in said body.

4. The noise-abating railway assembly defined in claim 1 wherein said sound-proofing members each have a sound-absorbing portion below said upper ends extending above the level of said rail.

5. The noise-abating railway assembly defined in claim 4 wherein said members have portions extending toward said aprons and said aprons have portions extending toward said members.

6. The noise-abating railway assembly defined in claim 4 wherein said members are formed with stiffening channels proximal to said support plane and adapted to accommodate electrical cables.

7. The noise-abating railway assembly defined in claim 6 wherein said members have second channels at said upper ends thereof adapted to accommodate electrical cables.

8. The noise-abating railway assembly defined in claim 4 wherein said members have respective flexible fins merging bases of said members with said supporting plane.

9. The noise-abating railway assembly defined in claim 4 wherein each of said aprons and the respective sound-proofing member have facing surfaces defining the respective slot, at least one of the surfaces defining each of said slots having an anti-friction member thereon.

10. The noise-abating railway assembly defined in claim 4 wherein said aprons have finning for forced cooling of said bogie.

11. The noise-abating railway assembly defined in claim 4 wherein said case is made of an alveolar fiber glass.

* * * * *